United States Patent [19]

Weber

[11] 4,253,045

[45] Feb. 24, 1981

[54] FLICKERING FLAME EFFECT ELECTRIC LIGHT CONTROLLER

[76] Inventor: Harold J. Weber, 20 Whitney Dr., Sherborn, Mass. 01770

[21] Appl. No.: 11,893

[22] Filed: Feb. 12, 1979

[51] Int. Cl.[3] ..... H05B 37/02; H05B 39/04; H05B 41/36

[52] U.S. Cl. ..... 315/210; 315/209 R; 315/297; 315/313

[58] Field of Search ..... 340/371; 315/200 R, 315/209 R, 210, 294, 297, 312, 313, 323

[56] References Cited

U.S. PATENT DOCUMENTS

| | | | |
|---|---|---|---|
| 3,265,907 | 8/1966 | Kurata et al. | 315/294 |
| 3,299,320 | 1/1967 | Kurata et al. | 315/210 |
| 3,321,666 | 3/1967 | Garnett et al. | 315/209 R |
| 3,500,126 | 3/1970 | Ford | 315/209 R |
| 3,534,224 | 10/1970 | Skirpan | 315/312 |
| 3,710,182 | 1/1973 | Van Reenen | 315/199 |
| 3,715,624 | 2/1973 | Herman | 315/209 R |
| 4,014,167 | 5/1977 | Hasegawa et al. | 340/371 |
| 4,064,414 | 12/1977 | Bergeson et al. | 315/200 R |

*Primary Examiner*—Alfred E. Smith
*Assistant Examiner*—Thomas P. O'Hare

[57] ABSTRACT

An electric light controller which serves to connect and disconnect an electric lamp element load from a power source in such rapid-fire pseudorandom seuentiality that the electric lamp appears to the eye as an illusion simulating the fluctuant brightness variations inherent in a flickering flame produced light. The result is an improved specious effect for decorative items such as electric lanterns used for outdoor lighting, simulated burning fireplace log arrangements, decorative chandeliers, holiday lighting equipment such as Christmas tree lights, and other such devices. Further enhancement of realism of the produced effect is provided for "open fire" decorative apparatus, such as electric fireplace log arrangements, through the optional inclusion of a popping acoustical sound translator, excited by a pseudorandom audio signal, which serves to simulate the crackling sound made by a burning material.

26 Claims, 31 Drawing Figures

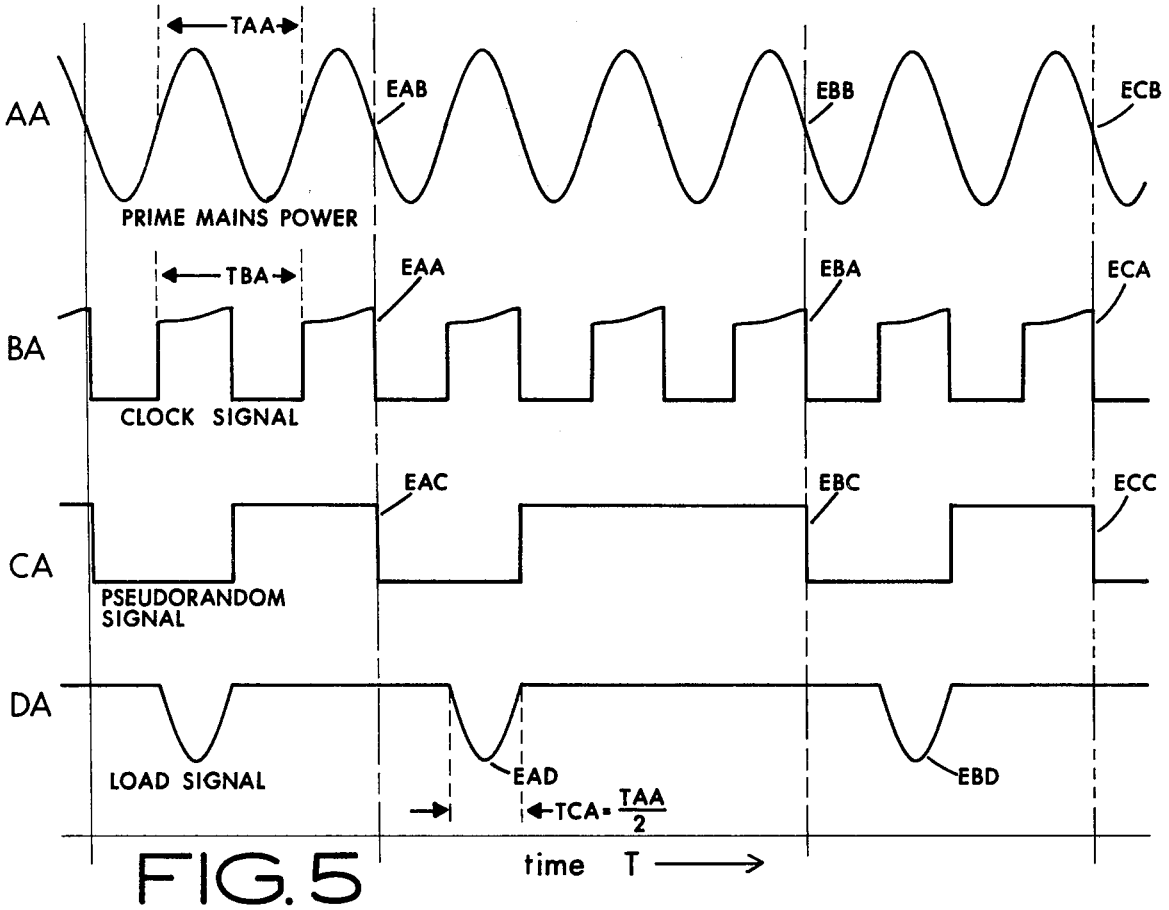
FIG. 5
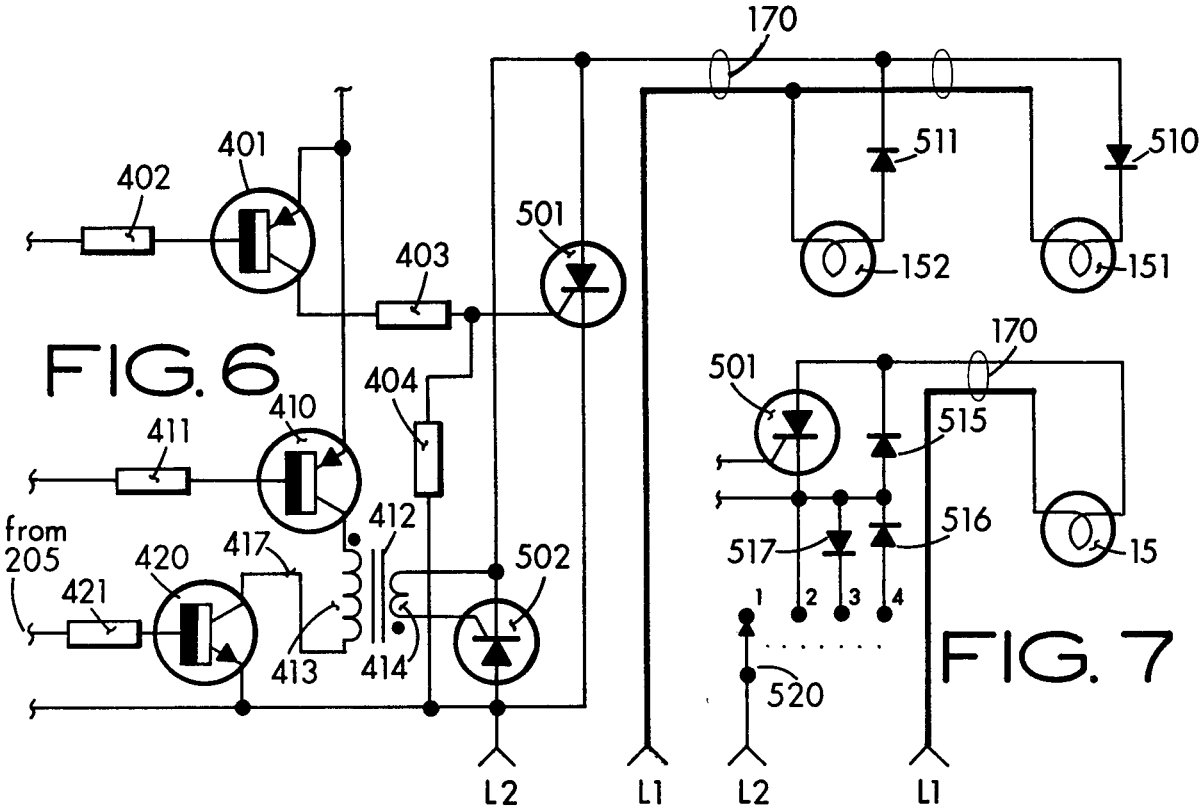
FIG. 6
FIG. 7

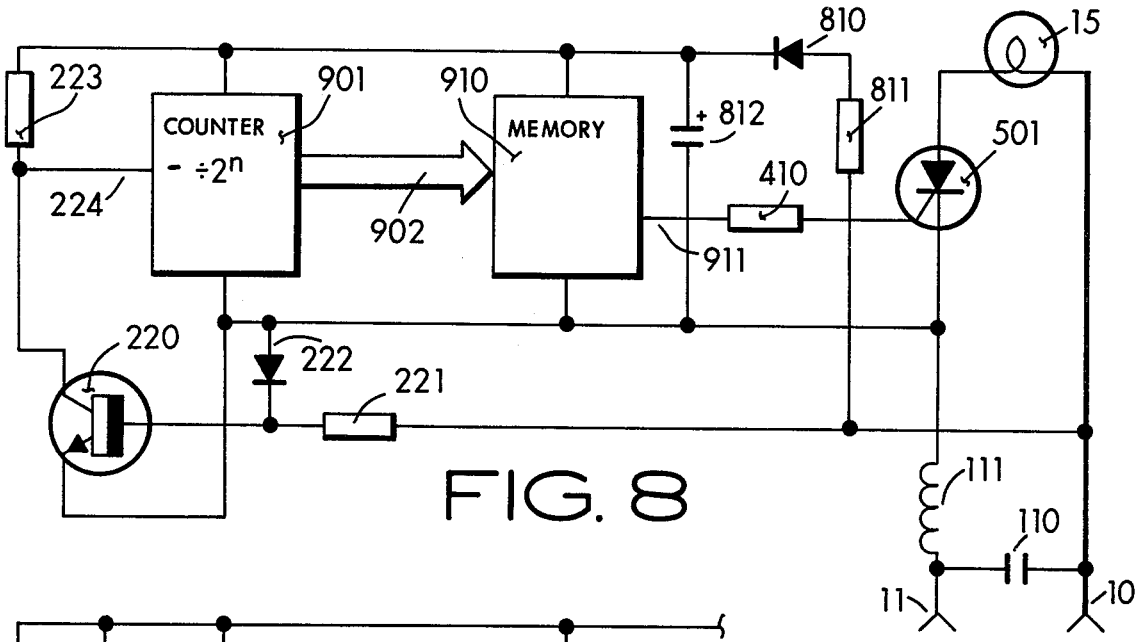
FIG. 8
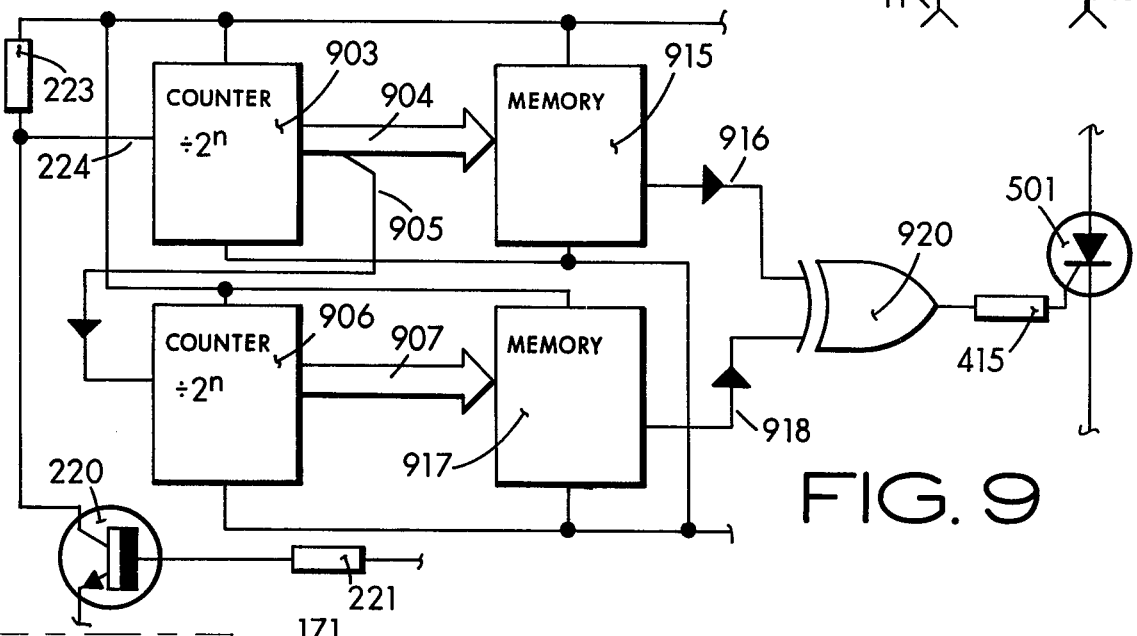
FIG. 9
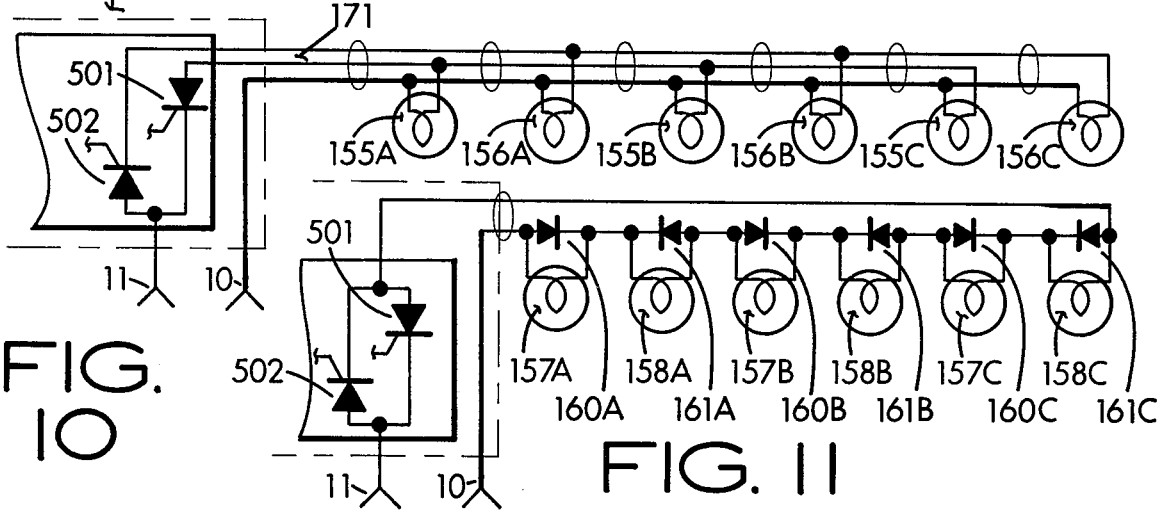
FIG. 10
FIG. 11

SOUNDER
750
+Vc
718
716
717
715
-Vc
657

711
710
656
655
302
304

661
660
Q
Q̄
J
K
CK
÷2

FLICKERING FLAME EFFECT ELECTRIC LIGHT CONTROLLER

BACKGROUND OF MY INVENTION

This invention relates to that class of devices oftimes employed to create the illusory effect of a fluttering open flame. Such an effect is frequently desired for purpose of establishing a mood or atmosphere, as in a restaurant or lounge; creating a pseudonatural illusion, as for example a flame lit lamp for outdoor lighting or a candlelit chandelier; for simulating a burning fire as in a fireplace or the like; for creating more natural appearing traditional effects, a good example of which is candlelit appearing Christmas tree lights or the like; and a contingent of other such devices. Previous art abounds with devices attempting to satisfy this need in the form of flashers, blinkers, unstable mode gaseous lamps, mechanical shutter devices, and the like. However, in-so-far as is known, no completely binary means has been produced until this instant invention which is capable of producing an illusory effect which has all the random appearing character of nature, and is yet inexpensive to implement in quantity and requires no adjustment thereby permitting inclusion in a wide variety of products having a diversity of requirements regarding average power, or where size, color, shape, electrical power requirements, and the like are concerned. Furthermore my instant implementation is brought about through digital signal manipulation which is functionally dependent upon the state selection of a combinatorial logic circuit, thereby precluding the usual ambiguity associated with earlier known analog control circuits which require ready adjustment means, at least during manufacture, to optimize the operation: a requirement which necessitates higher manufacturing cost and less permanence of performance. In addition the taught apparatus surpasses prior art in that it is capable of operating in an extreme range of temperature, without performance variation, from near minus 40 degrees Celsius to near plus 85 degrees Celsius. No moving parts or adjustable elements are employed in the implementation of the basic teachings, the device being commercialized as an ensheathed capsule, usually impregnated with a plastic compound, or potting agent, so as to form an environmentally independent containment for the workings of the device.

SUMMARY

My invention describes an electric light controller which serves to connect effectively between a source of mains power and an electric lamp element load arrangement and is operative therewith so as to modulate the electric power applied to the lamp element in a substantially pseudorandom pattern which resultingly produces a variegated lighting effect simulating the fluctuant light produced by an open combustive flame-lit lamp or the like. An electrical switching device such as a thyristor controllingly connects the primary mains power current to the electric lamp element. In the usual practice of my invention, the mains power is conventional alternating current utility power, while the electric lamp element is a filamentary type incandescent light bulb. A source of binary pseudorandom signal is provided, as for example, from a cascaded oscillatory circuit connected as a pseudorandom pulse generator, an electrical memory circuit programmed in a pseudorandom binary bit pattern, or other such means. The pseudorandom signal serves to couple to the gate or like control element which forms a part of the thyristor switch, resulting in the effectual control of at least integral half cycles current flow between the thyristor input and output terminals in accord with the pseudorandom signal pattern.

It is therefore a primary object of my invention to teach an electrically efficient apparatus which will provide an improvement in the environment in the form of more natural and interesting lighting effects than what is produced by ordinary electric lighting devices, thereby stimulating a more susceptive relationship between a person and his surroundings.

A further significant object of my invention is to provide an electric lamp element controller which serves to particularly stage the power flow to the lamp as a series of integral half cycle electrical pulses which exhibit an improved short term pattern of recurrence randomness so as to effectuate a variegated specious lighting effect.

Another object of my invention is to provide a binary pseudorandom control signal which is synchronized with the alternating current cycles and therewith exhibits a goodly degree of randomness and is substantially independent of component tolerance, environmental conditions, and manufacturing skill.

Yet another object of my invention is to provide a flickering flame effect light controller which is applicable to electric lamp elements of a broad variety, as for example, conventional incandescent lamp bulbs operating on but a few watts as well as large lamp bulb arrangements consuming many kilowatts of power.

Still another object of my invention is to provide essentially "zero crossing" switch action for the load, resulting in at least full integral half-cycle power flow to the load, thereby eliminating the electrical noise transients produced by partial half-cycle power control as provided by phase controlled firing.

A further object of my invention is to provide the separate control of a second lamp means over a common electrical conductor through first switch means controlled first direction control of current flow in a first pseudorandom pattern to a first lamp, whilst a second switch means controlled second direction control of current flow passes to a second lamp in a second pseudorandom pattern.

A still further object of my invention is to provide a pseudorandom audio signal which serves to energize an audio translator into producing sound simulations typical of the popping and crackling of an open burning material as, for example, a fireplace log or the like.

Taught by my invention is the operative combination of semiconductor switching devices and semiconductor signal generative devices as a composite, low cost control means for a variety of decorative lighting effect devices.

Further taught by my invention is the operation of all circuit means from power derived from the mains power with a minimum of extra components and usually no changes to existing wiring schemes as commonly employed with commercial lighting devices.

Still further taught by my invention is control apparatus which requires little or no change in the appurtenant lighting device and is therefore readily installable by technically unskilled persons.

BRIEF DESCRIPTION OF DRAWINGS

The drawings include ten sheets containing thirtyone figures.

FIG. 5—Waveform representations for the exampled circuits of FIGS. 3 and 4.

FIG. 6—Circuit detail giving example for driving two loads with separate acting power signals.

FIG. 7—Circuit detail for switch selection of the controller operating modes.

FIG. 8—Elemental schematic showing the use of a memory means as a source for pseudorandom signals.

FIG. 9—Extension of memory stored pseudorandom signal sequence length as the product of each memory capacity.

FIG. 10—Dual control signal excitation of a string of holiday lights or the like using independent wire feed.

FIG. 11—Dual control signal excitation of a string of holiday lights or the like using two wire feed.

DESCRIPTION OF PREFERRED EMBODIMENT

Several forms for my new invention are discussed with examples of particular means given so as to enable an artisan of average skill to duplicate the fruits of my teachings. In no way are these forms or examples limiting as to the scope of my teachings, but shall include any means understood in the field which will perform in an equivalent manner.

Figure 1:
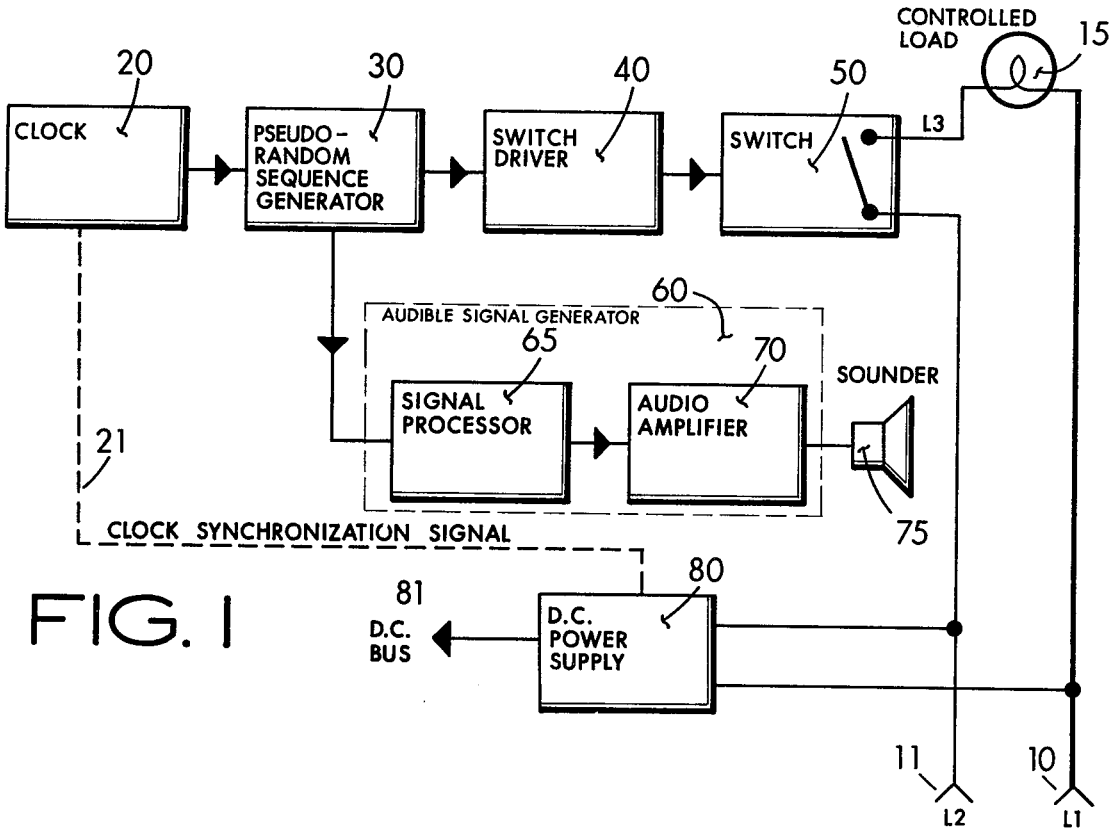
FIG. 1—Functional diagram showing the essence of my invention driving one lamp and an audio signal.

In FIG. 1 a source of alternating current prime power 10,11 is shown substantially coupled to a controlled load 15, as say an incandescent lamp or the like, by way of switch 50. Binary control signals for the switch 50 are provided for by a clock 20 which couples to a pseudorandom sequence generator 30. Such a generator 30 shall consist of a cascaded oscillatory circuit connected as a binary pseudorandom pulse generator, a binary counter means operative to sequence an electronic memory through a series of preprogrammed pseudorandom combinations, or any like means which shall suit the purpose of providing a variegated binary signal offering at least good short term irregularity, or randomness. The said generator 30 couples to a switch driver means 40 which serves to control the switch 50 which is usually a thyristor such as a silicon controlled rectifier, triac, or the like. The switch operates to pass at least substantially full half cycles of a.c. power to the load when initiated by the driver. The result is a flow of irregular binary power pulses of at least half cycle duration to the load.

Shown also is an audible signal generator 60, which includes a signal processor 65 coupled to the said generator 30 and operative so as to produce audio signals therefrom which exhibit some degree of randomness. The signal processor 65 couples to an audio amplifier 70 which serves to amplify the audio signal and couple to audio translator, or sounder 75, as say a small radio loudspeaker or the like.

The result of the FIG. 1 combination is a controlled lamp load which flickers with the specious effect of a burning flame, accompanied by a popping or crackling sound reminiscent of a burning material, as for example a log in a fireplace.

Shown also is a D.C. power supply 80 coupled to the mains power 10, 11 and operative to provide D.C. operating power to the electrical control circuits by way of the D.C. bus 81. A clock synchronization signal 21 is also shown, derived from the essential A.C. component provided by the supply means 80 and operative to control the clock 20 so as to effect advances of the pseudorandom sequence in accord with the a.c. cycles and thereby further effect zero crossing switching for the controlled load 15.

Figure 2:
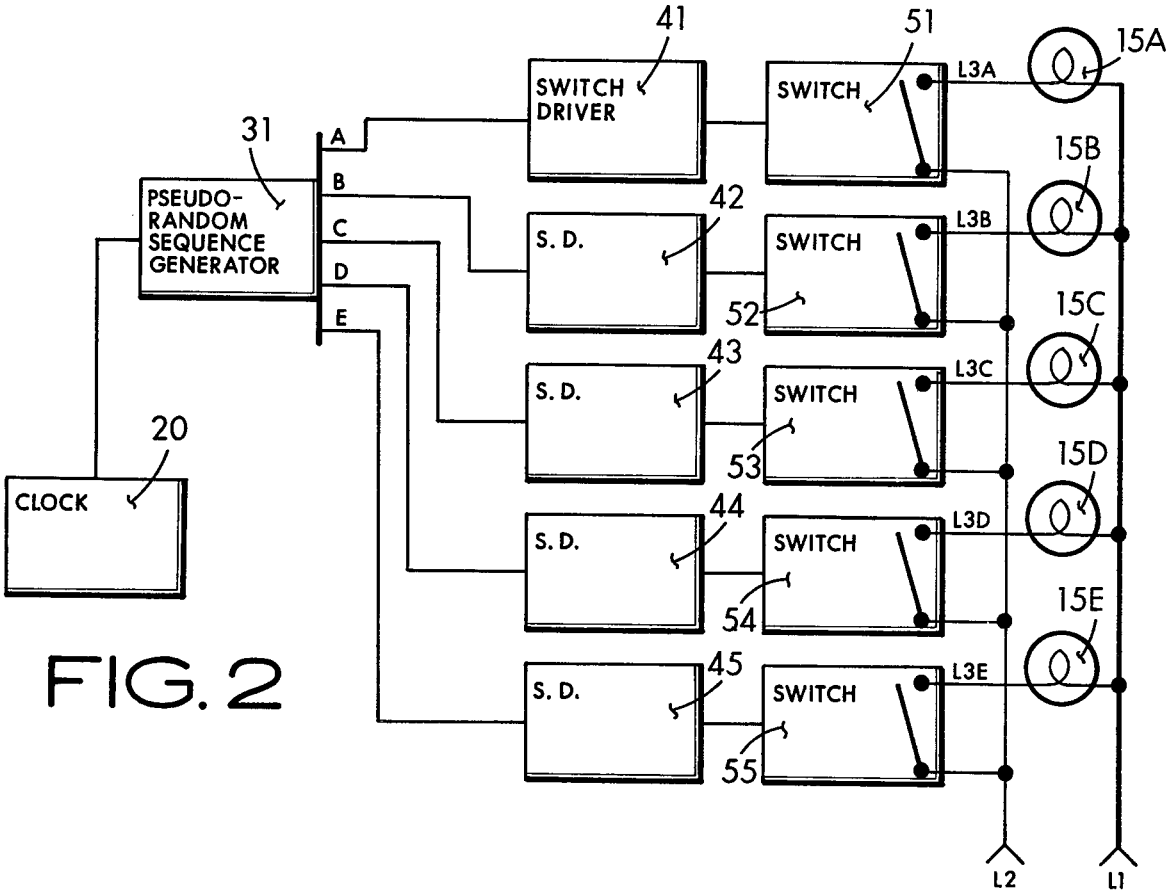
FIG. 2—Functional diagram showing the essence of my invention driving five separate loads with separate-acting flickering effect signals.

A variant control means is shown in FIG. 2 which serves to drive some plurality of controlled loads 15A, 15B, 15C, 15D, 15E by way of switches 51, 52, 53, 54, 55 and switch drivers 41, 42, 43 44, 45 wherein the said switch drivers are controlled by separate signals from the pseudorandom sequence generator 31, with each said separate signal A, B, C, D, E exhibiting relative non-synchronous pseudorandomness. The result is a plurality of loads which flicker in a way apparently unrelated to one another, in-so-far as practical observation by a person is concerned.

Figure 3:
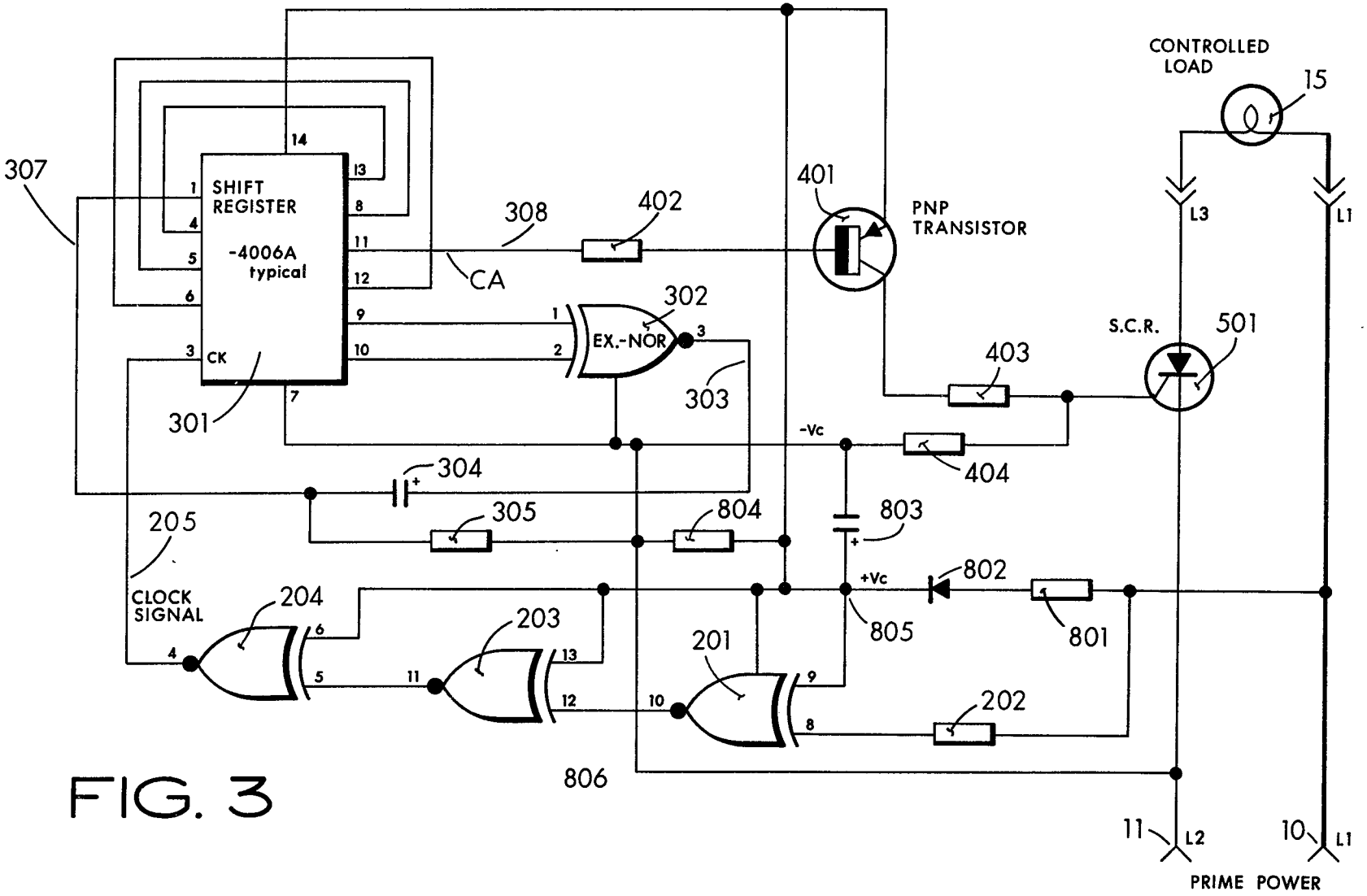
FIG. 3—Schematic for a controller employing a separate thyristor gate driver and a particular form of antilatchup circuitry.

The electrical diagram for one form for a flicker light controller appears in FIG. 3. The prime a.c. power 10, 11 couples to the controlled load 15 by way of thyristor 501. Prime power line L2, 11 serves as circuit common (or negative as shown), whilst line L1, 10 is coupled through resistor 801, say 33-K ohms, to diode 802 which rectifies the voltage producing a D.C. value across filter capacitor 803 as $+V_c$ 805 with an average value of about +8 volts as which appears across bleeder resistor 804 to $-V_c$ 806.

A clock synchronization signal couples from line L1 through resistor 202 to inverter 201. The 60 hertz (50 hertz) output from buffer 201 couples to second and third buffers 203, 204 for further shaping before coupling to the CLOCK input on SHIFT REGISTER 301. The shift register, in the connection shown, operates as a seventeen stage pseudorandom pulse generator, producing a string of relatively random pulse periods about $2^{17}$ 1 clock pulse periods in length before repeating, meaning the sequence is over one half hour long before recurring. This is a considerably longer period than what a person might tend to recognize as being a repeatative pulse sequence. However such long pulse sequences have merit in reducing to insignificant proportions the happenstance probability of a large number of separately controlled lamps, for example a street lined with controlled post lanterns, having a recurrent pattern which is apparently similar. This is brought about due to the relatively random start-up states of each controller when first turned on and, therefore with many available states, the liklihood of similiar patterns occurring simultaneously from a string of controllers is small. This serves to preserve the overall natural effect of the resulting light.

The shift register includes the EXCLUSIVE-NOR gate 302 and anti-latchup circuitry including capacitor 304 and pull-down resistor 305. The output of the D2+4 state of the particular exampled CD-4006A C-MOS integrated circuit shift register (i.e., pin 11) provides an output coupled through a resistor 402 to the base of PNP transistor 401. A logic "O" on the shift register pin 11 output results in the turning "ON" of transistor 401 through resistors 403, 404 and also enabling the gate of thyristor 501, turning "ON" the thyristor and permitting current to flow to the controlled load 15.

The practitioner is reminded that, while a particular C-MOS shift register arrangement is shown, any hookup suited to the requirement for generating a pattern of irregular pulses might just as well be used. Also other outputs from the exampled CD-4006A shift register might just as well be used to drive the transistor 401; the output of gate 302 may also drive the output circuits.

Figure 4:
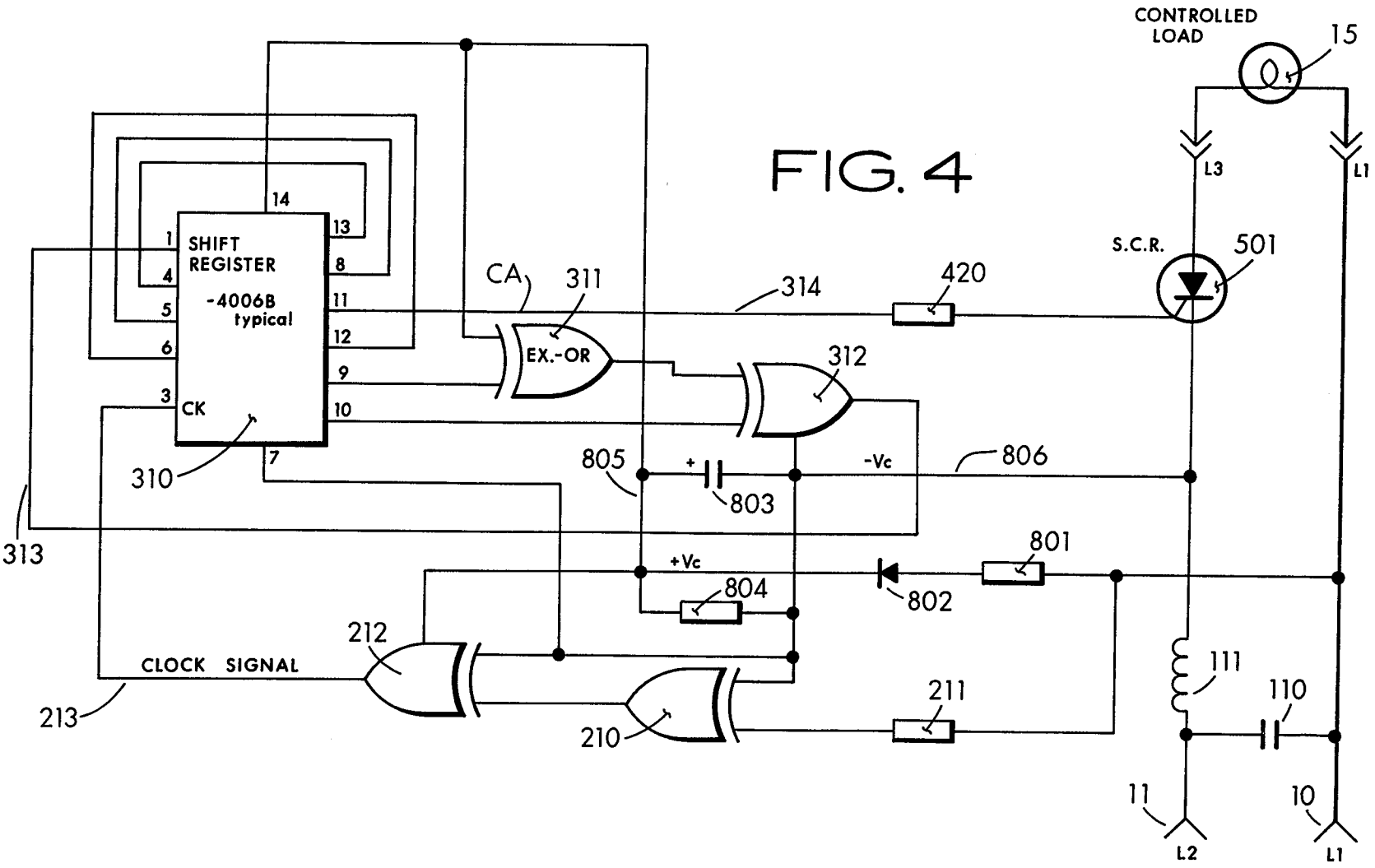
FIG. 4—Schematic for a controller employing a minimized number of components, yet achieving the desired effect.

FIG. 4 teaches a highly effective, very nearly minimum parts count controller employing shift register produced binary pseudorandom sequences. The line 10 couples through resistor 211, say 470-K ohms, to cascaded inverters 210, 212 producing a CLOCK SIGNAL 213 coupled to the CLOCK input of shift register 310 which is generally synchronized to the a.c. waveform prime power. The shift register is connected in a manner similiar to FIG. 3 except for the novel inverting of one output by inverter 311 as coupled to EXCLUSIVE-OR gate 312. This inversion appears to reduce happenchance latchup of the shift register output, negating the need for any further anti-latchup circuitry in this application. The output of gate 312 couples 313 to the input of the shift register so as to recirculate the pulse sequences. Another cost improvement is found in the direct excitation of the thyristor 501 by the output, pin 11 for example, of the shift register through resistor 420. For small, or high gate sensitivty, thyristors this cost effective connection works very well, although the connection of FIG. 3 with the buffer transistor 401 is preferred for larger thyristors.

An anti-hash, or radio frequency interference, filter 110, 111 is shown and may be required with some controllers, depending upon the application and the susceptibility of the surrounds to any electromagnetic interference which may be produced by nonlinearities characteristic of some types of thyristors.

Waveforms for the typical signals in the circuits of FIG. 3 and FIG. 4 appear in FIG. 5. Waveform AA is the mains power alternating current, say 60 hertz (50 hertz), so that:

$$\text{period } TAA = 1/F,$$

where:

F=60 hertz (50 hertz),

TAA=16.67 milliseconds (20 mS).

Waveform BA shows typical CLOCK SIGNAL pulses with time TBA=TAA, and with the clock NEGATIVE edge EAA, EBA nearly coincident with the waveform AA zero-crossing poing EAB, EBB. The binary pseudorandom pulse signal CA produces signals EAC, EBC which serve to enable the thyristor switch, so as to produce at least integral half cycle power pulses DA across the controlled load, with the switch-on EAD, EBD coincident with the prime power waveform zero value, i.e., zero-crossing point.

Two thyristors 501, 502 are shown in inverse-parallel connection in FIG. 6. The first thyristor 501 is driven as in FIG. 3, whilst the second thyristor is driven by a second PNP transistor 410 through resistor 411 from a DIFFERENT shift register (sequence generator) 301 output than that employed for transistor 401., for example pin 9. The emitter of transistor 410 connects to $+V_c$, with the collector connected to one end of the primary winding 413 of transformer 412. The second end of the primary winding 413 connects to the collector of a NPN transistor 420. The emitter of transistor 420 connects to $-V_c$, while the base is driven by CLOCK pulses 205 through resistor 421. The overall result is that a logic LOW pseudorandom signal on pin 9 may turn ON transistor 410; however current flow through the transformer primary 413 will be inhibited until transistor 420 is turned ON by a HIGH clock pulse.

The artisan will realize that, in the exampled configuration, pulses on pin 9 may occur during the NEGATIVE clock cycle, whilst turn-on of device 420 occurs only during the POSITIVE clock cycle. The phasing is provided so that a POSITIVE clock cycle coincides with a POSITIVE value on the thyristor 502 anode. The result is that the CLOCK pulse, operating conjunctively with device 420, determines the turn-on signal pulse timing for the thyristor. This is accomplished by the coupling through transformer 412 to the secondary winding 414; the purpose for the transformer mainly being to serve to isolate the inverse connected thyristor, since the $-V_c$ d.c. line for the controller connects to input L2 and so does the thyristor anode of device 502. The result is the flow of two distinctive power signals over interconnecting lines 170, which couple to lamps 151, 152 through steering diodes 510, 511. The effect is that the pseudorandom power signal produced by thyristor 501 will couple through diode 511 and effect only lamp 152, whilst the power signal produced by thyristor 502 will couple through diode 510 and effect only lamp 151. Such a combination might be any useful arrangement of lamps, such as a holiday light string, viz Christmas Tree lights, etc.

The thyristor 501 is shown in FIG. 7 to be shunted by an inverse connected parallel power diode 515, resulting in full power applied to the load 15 for one-half cycle by way of the diode, while the thyristor 501 serves to modulate the power flow to the load on the other half cycle. What is further taught is the inclusion of switch 520 and steering diodes 516, 517. In switch position 1, power is OFF. In switch position 2, power couples direct to the controller and produces a pseudorandom 50% to 100% power flow to the load 15. In position 3, the switch connects diode 517 in series with the controller and results in pseudorandom 0% to 50% power flow to the load 15. In switch position 4, diode 516 is connected in series with the controller and inhibits the thyristor action, resulting in 50% steady power flow to the load 15.

A pseudorandom sequence generator based on the use of a $\div 2^n$ counter and a "n word 1 bit" memory 910 is shown in FIG. 8. Clock pulses derived from the mains power 10 through resistor 221 are conditioned by transistor 220 and clamp diode 222 producing clock pulses 224 across load resistor 223, which serve to sequence counter 901. The binary outputs of the counter couple 902 to the memory address lines of memory device 910, a "read only memory" (ROM) pre-programmed in a pseudorandom sequence. The memory output couples to thyristor 501 through resistor 410.

A variant pseudorandom sequence generator is shown in FIG. 9 which uses more than one "n word 1 bit" ROM 915, 917 driven by counters 903, 906 through address bus 904, 907. The novelty lies in the use of a combinatorial gate, as an EXCLUSIVE-OR gate for example, in the memory outputs. Furthermore counter 906 advances only one count for every full count of counter 903. What results is the combination of pseudorandom signals available at the output of gate 920 is equal to the product of the words stored in each memory and, for an example of two 256 word by one bit memories, can result in 65,536 combinations, or more than fifteen minute sequences at a 60 hertz clock rate. Further refinement anticipates the use of up-down counters for 903, 906 which are separately reversed in count phase, or direction, after each sequence, meaning that for the shown hookup, up to 262,144 counts occur before the entire sequence repeats resulting in a unique sequence well over one hour in duration.

An arrangement for use with holiday type lights, viz Christmas tree lights, etc., is shown in FIG. 10. Two separate thyristor switches 501, 502 serve to drive two separate circuits to alternant light bulbs 155A, 155B, 155C, 156A, 156B, 156C and cause a specious effect of flickering candles or the like. This illusion appears as a considerable improvement over known art forms using flashers and blinkers which repeat only the same pronounced on and off pattern. The reduced average lamp power also increases bulb life, and since the on and off action is less pronounced, excessive lamp filament surges are reduced.

A variation for the holiday lights is shown in FIG. 11 wherein thyristors 501, 502 drive a two wire connection to the bulbs and wherein further the bulbs have parallel diodes in alternant polarity opposition. What results is that bulbs 157A, 157B, 157C are series driven by thyristor 502, whilst bulbs 158A, 158B, 158C are series driven by thyristor 501.

Figure 12:
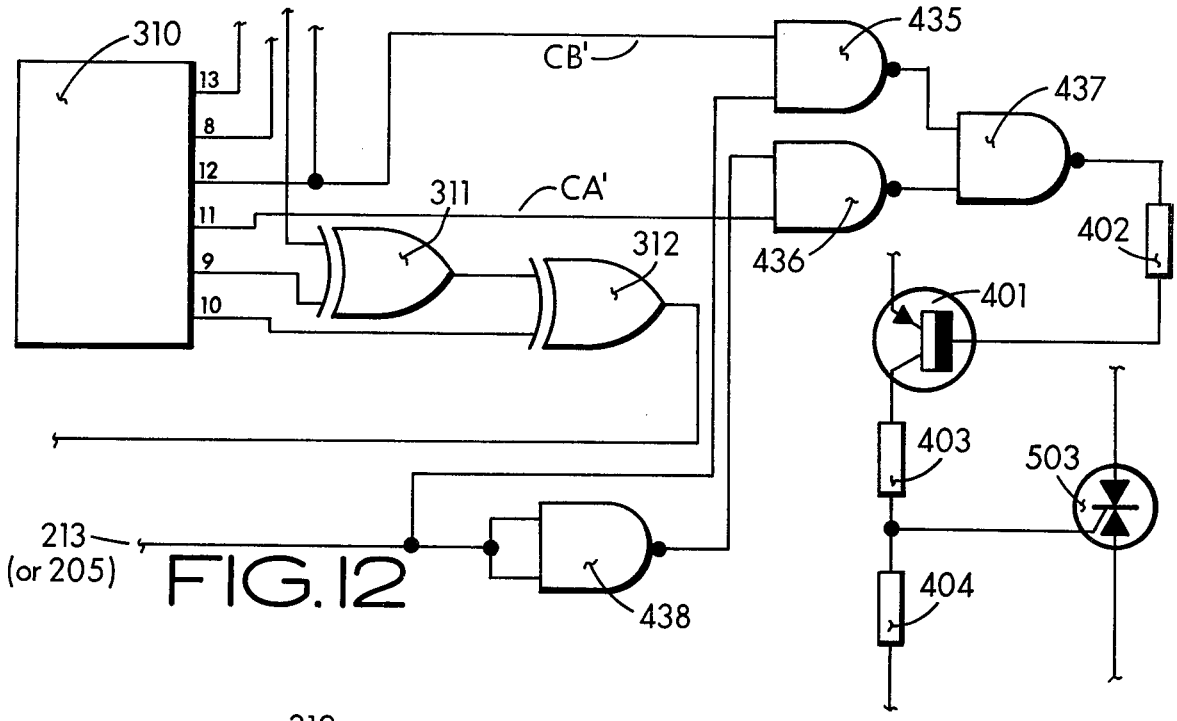
FIG. 12—Dual control signal excitation of bilateral thyristor so as to achieve separate control characteristic on each power half-cycle.

A reflex circuit means is depicted in FIG. 12 wherein the current flow in the first direction through bilateral thyristor (i.e., Triac or the like) 503 is controlled according to one pseudorandom sequence whilst the current flow in the second direction through the thyristor 503 is controlled according to a second pseudorandom sequence. The result is an effect which is similar to that taught for FIG. 6 and exampledly used in FIG. 11. However the means for accomplishing the result is more novel. NAND gates 435, 436, 437 such as CD-4011 or the like form a 2-input data selector, where one data line for gate 435 is derived from a first output, say pin 12, from shift register 310 and a second data line for gate 436 is derived from a second output, say pin 11, from shift register 310. Also one of the data lines, for gate 435 or 436 could be coupled from the output of gate 312. What results is that the pseudorandom sequence on one data line will effectively differ from that on the other data line. CLOCK pulse signals 213 (or 205) coupled from circuits exampled in FIG. 3 or 4 serve to alternately enable the inputs of gates 435 or 436, said gate 436 being fed an inverted CLOCK signal via inverter 438. The result is that the pseudorandom DATA on the input of selector gate 435 will be coupled to transistor 401 on the POSITIVE half cycles of the CLOCK pulse, while DATA on the input of selector gate 436 will be coupled to transistor 401 on the NEGATIVE half cycle of the CLOCK pulse. The result is each half cycle of the mains power, as coupled by the bilateral switch 503 to the load will be sequenced according to a distinctly different pattern. The advantage is the provision of a dual pattern controlled output power signal at the expense of only one low-cost quad 2-input NAND gate, or the like.

Figure 13:
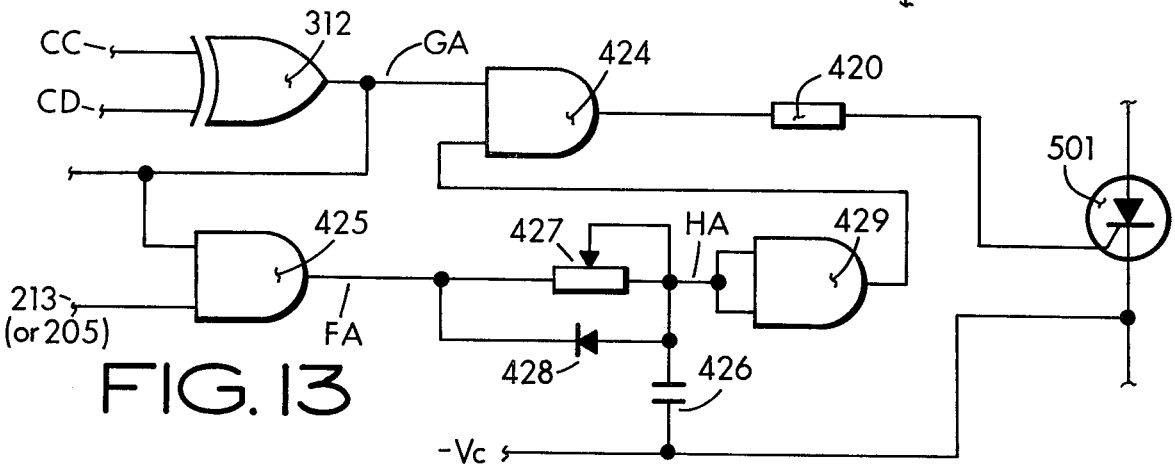
FIG. 13—Dimming, or control of average load power, is shown as related to circuits like that in FIG. 3 or 4.

A flicker light controller including provision for DIMMING, or output power level adjustment, is shown in FIG. 13. When used conjunctively with the teachings of FIG. 3 or 4, the result is a flickering light effect which can be varied in peak intensity value from about zero to maximum with merely the control of one potentiometer 427. This operation is in much the manner of the well known dimmer control used on ordinary steady state lighting arrangements, and the applicable purposes are much the same, i.e., to effect mood settings, reduce glare, conserve power, etc.

CLOCK pulse signals 213 (or 205) coupled from circuits exampled in FIG. 3 and 4 couple to AND gate 425, say CD4081, with the other gate input being enabled by pseudorandom sequence signals GA from the output of gate 312, or like source. The result is gated CLOCK signals FA occur on the output of gate 425 when the said sequence signal GA is logic HIGH. The sequence signal GA also couples to one input of AND gate 424. However the second gate 424 input is held logic LOW, disabling the gate. Meanwhile gated clock signal FA, when logic HIGH, serves to charge capacitor 426 through whatever resistance is presented by potentiometer 427, depending upon its setting. With suitable values, say 500-K ohms for potentiometer 427, and 20 nanofarads for capacitor 426, the delay produced by this charging action on line HA will cause a delayed transistion of gate 429 to a HIGH logic state at the output, as presented to the input of gate 424. The result is the TURN-ON of gate 424 will be delayed, in proportion to the potentiometer setting, for each CLOCK half-cycle and therefore for each gate firing cycle for thyristor 501; the effect is to alter the firing angle of the thyristor as a means for controlling the average load power. However, the firing angle for any potentiometer setting will be constant irrespective of the pseudorandom flicker control signal, reducing the noise produced to a constant value.

Figure 14:
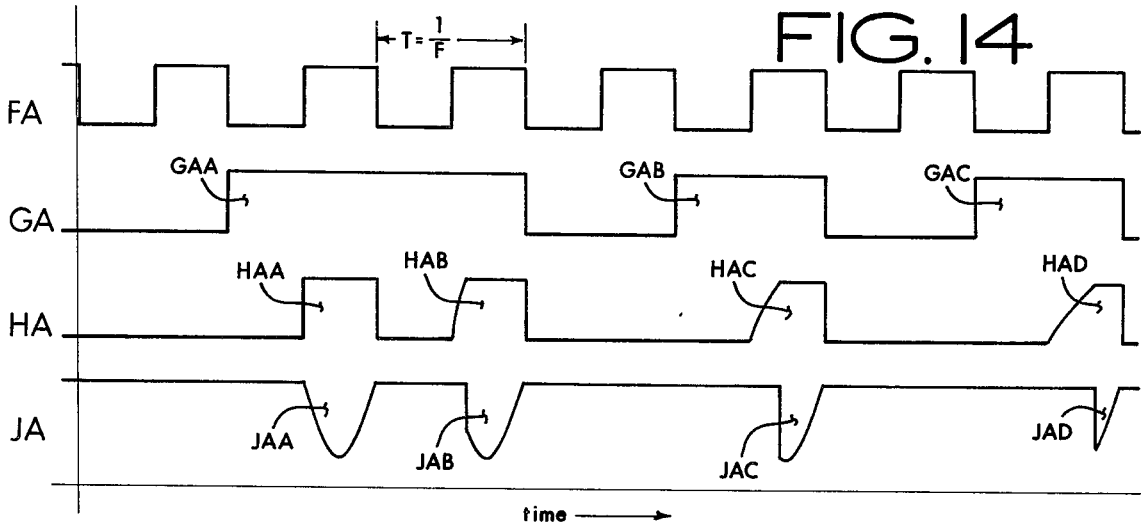
FIG. 14—Waveform representations particularly related to the dimming action exampled in FIG. 13.

A more clear understanding of this action may be attained from the waveforms in FIG. 14. The clock signal pulses FA are shown, having a period:

$$T=1/F,$$

where

F=60 hertz (50 hertz)

T=16.67 mS (20 mS)

A typical pseudorandom sequence signal GA is shown where individual signal waveforms GAA, GAB, GAC merely represent but a few of a very large number continuum of pseudorandom signal waveforms. The signal HA, corresponding to the like signal point HA in FIG. 13, shows the charging action. The waveform, as shown, is limited from zero value to that value where gate 429 might be expected to "switch-over", that is transistion, usually about 40% to 50% of $+V_c$ for C-MOS integrated circuits. The charge on capacitor 426, while not apparent from the waveform HA, continues to exponentially charge to near $+V_c$, or until discharged by reset diode 428 when gate 425 output FA is logic LOW, as on the NEGATIVE clock pulse period, or else when the pseudorandom signal output from gate 312 is logic LOW. The power signals JA delivered to the controlled load show fractionalization in accord with the amount of delay introduced by the action on signal line HA.

Figure 15:
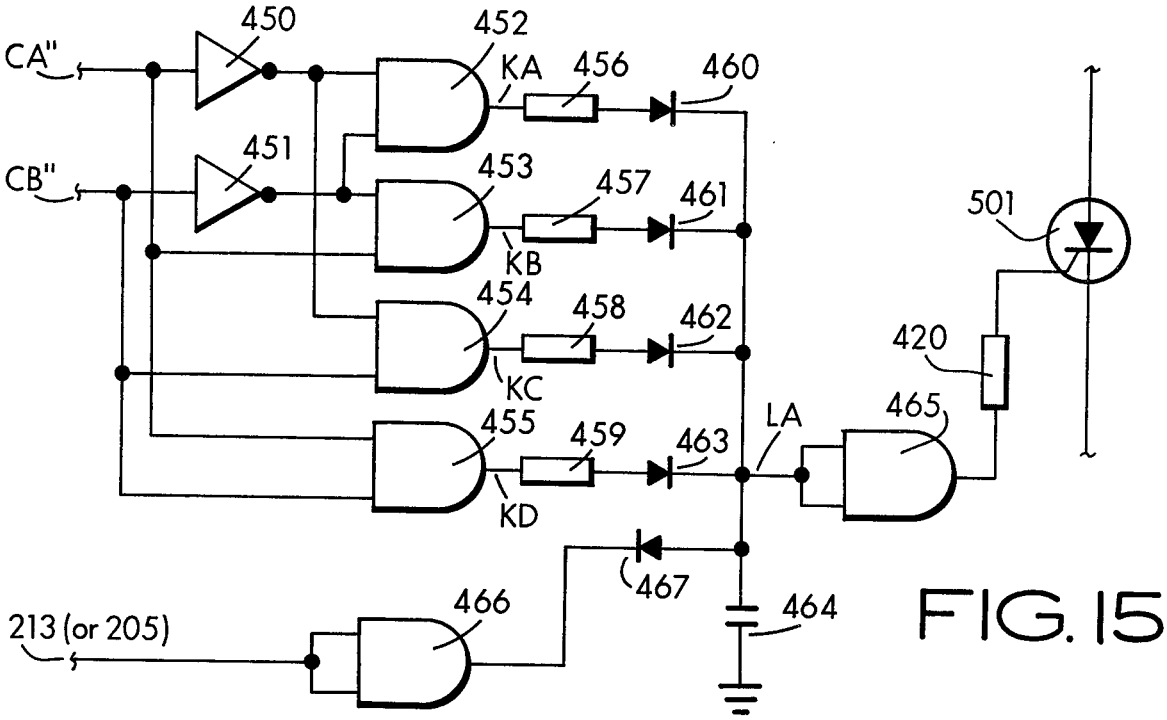
FIG. 15—Implementation of line operated pseudorandom generator controlled circuit having five separate lamp loads, each producing a distinctly different flicker effect.

Some circuit detail for producing a binary, or digitally, controlled delayed phase angle firing signal for thyristor 501 appears in FIG. 15. Two inputs CA", CB" couple to individual outputs from pseudorandom sequence generator, for example 310 in FIG. 4, or else lines 916 and 918 in FIG. 9 for an alternate example. Inverters 450, 451 together with AND gates 452, 453, 454, 455 form a 2:4 line decoder, as:

| CA" | CB" | KA | KB | KC | KD |
|---|---|---|---|---|---|
| 0 | 0 | 1 | 0 | 0 | 0 |
| 1 | 0 | 0 | 1 | 0 | 0 |
| 0 | 1 | 0 | 0 | 1 | 0 |
| 1 | 1 | 0 | 0 | 0 | 1 |

The result of this is to produce a charging of capacitor 464 by way of one of the logic HIGH selected lines KA, KB, KC, KD through one of the associated charging resistors 456, 457, 458, 459. For example, if 456 is of relatively small resistance value, ascending to a high resistive value for resistor 459, the effect will be a substantial delay of the charging of capacitor 464 when output KD is logic HIGH as compared to when output KA is logic HIGH. Since the selector lines CA", CB" occur in a pseudorandom pattern sequence, this means the charge time for capacitor 464 will accordingly vary. While two selector lines provide only four value control, the effect is quite dramatic, and is enhanced due to the variation in interpulse character and thermal lag characteristics in the typical lamp element load. Another advantage achieved with this alternate novelty is that the fundamental power line frequence component, as divided down by some indirect effects of the shift register in that kind of sequence generator circuit, does not so pronouncedly appear in the resulting effect: i.e., the random nature is somewhat better.

CLOCK pulses 213 (or 205) couple through buffer 466, serving to discharge capacitor 464 through reset diode 467 on negative CLOCK half cycles. Steering diodes 460, 461, 462, 463 prevent discharge of capacitor 464 by logic LOW gate outputs.

Figure 16:
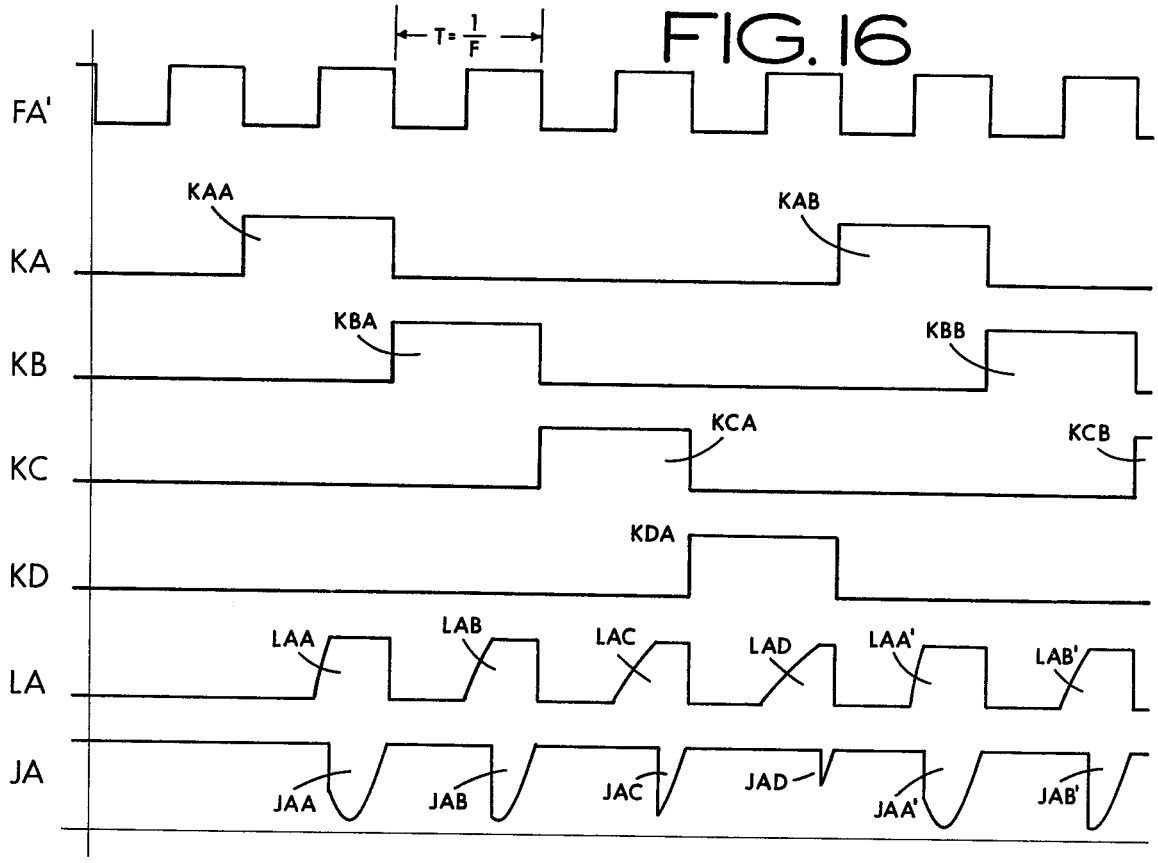
FIG. 16—Schematic for a counter driven memory controlled embodiment producing a variety of distinctly separate acting lamp load outputs.

The electrical signal sequences are best shown in FIG. 16. The CLOCK pulses are shown FA'. The typified four decoder outputs KA, KB, KC, KD are shown providing signal pulses KAA, KAB; KBA, KBB; KCA, KCB; and KDA. These signals, while herein appearing as a sequential pattern, in practice of my teachings occur in a pseudorandom pattern with no particular short term order, such being the essence of my invention.

Figures 17, 18, 19, 20, 21:
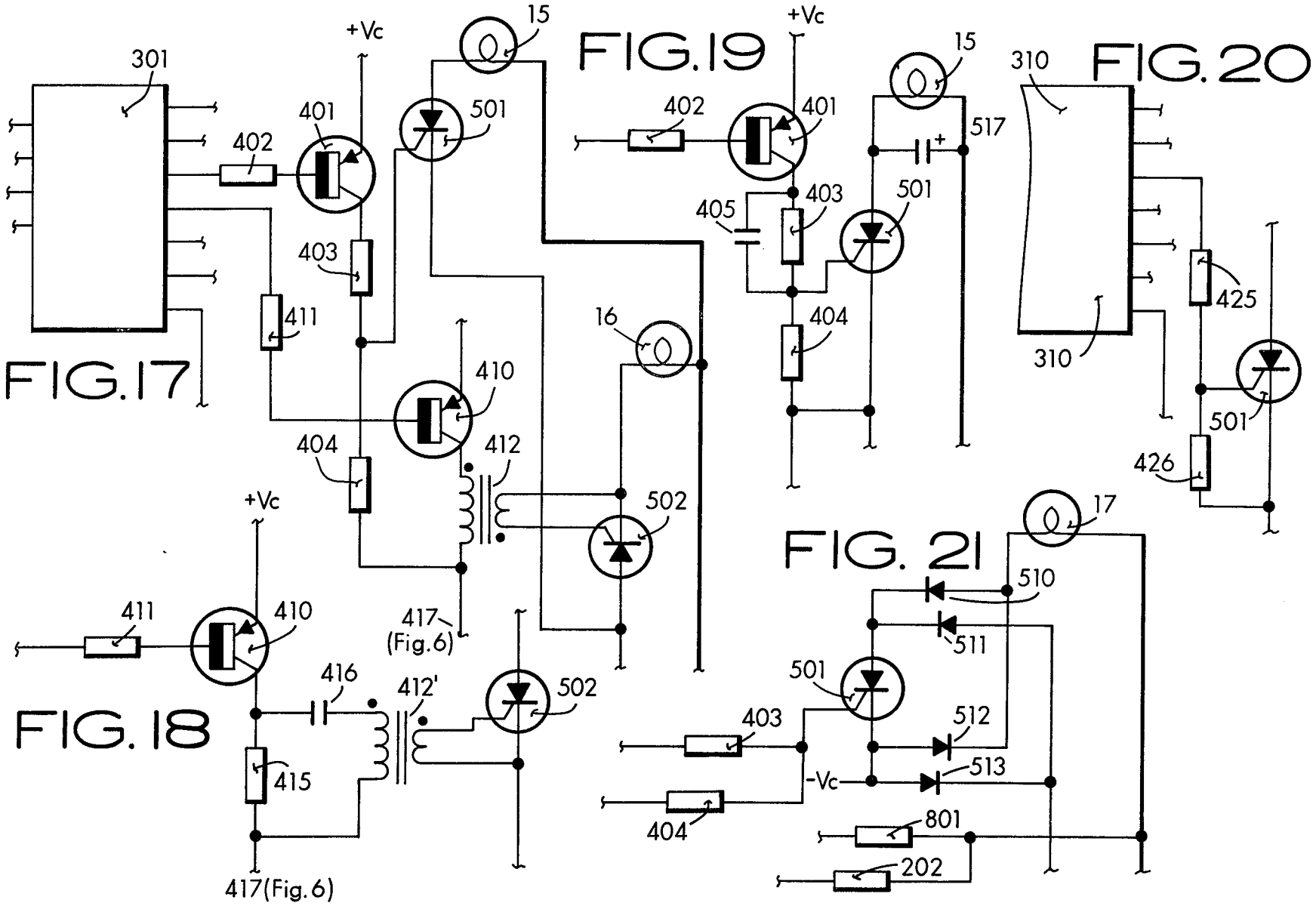
FIG. 17—Inverse connected thyristors driving separate loads and driven by separate signals from a common pseudorandom signal source.
FIG. 18—Circuit detail showing capacitor discharge of current pulses through the coupling transformer to reduce average power through the driver means.
FIG. 19—Shows the use of a speed-up capacitor to cancel the effects of high thyristor gate capacitance; further shows the use of a capacitor across the load to increase the effective load time constant for improved specious effect.
FIG. 20—Circuit detail showing the use of a gate swamping resistor as needed with low cost thyristors having high leakage values.
FIG. 21—Circuit detail for using a unilateral thyristor conjunctively with a diode bridge arrangement to achieve full-wave load power cycle control.

A separately driven light 16 is shown in FIG. 17 wherein the second control thyristor 502 output circuit is separate from the first control thyristor output circuit.

The use of a discharge capacitor 416 is depicted in FIG. 18, wherein the capacitor is discharged to $-V_c$ by resistor 415 and is charged to $+V_c$ by signal controlled transistor 410.

One improvement found in FIG. 19 is the use of a speedup capacitor in parallel with resistor 403, serving to negate any integrative effects produced by the parasitic gate capacitance associated with thyristor 501, allowing the use of a smaller value for resistor 403. This connection is of particular import for large thyristors.

Yet another improvement depicted in FIG. 19 is the use of a capacitor 517 across the load terminals. With typical values on the order of 10 to 70 microfarads, the performance and realism of certain types of incandescent lamp bulbs are markedly improved, especially when the lamp is of low wattage having a filament exhibiting small thermal inertia. The effect introduced by the capacitor is about the same as using a bulb of higher wattage and having greater thermal lag.

The use of a gate swamping resistor 421 is shown in FIG. 20 which serves as an adjunct to the circuit of FIG. 4, serving to reduce gate sensitivity to extraneous signals through gate impedance reduction. Typically the value of resistor 420 is 4,700 ohms for the smaller thyristors with good gate sensitivity, whereupon resistor 421 is shown to be about 1,500 ohms.

Full wave, full cycle excitation of the lamp load 16 using a half wave thyristor, i.e., silicon controlled rectifier or the like, is shown in FIG. 21. The thyristor is arranged within the connective framework of a diode bridge 510, 511, 512, 513 and as such serves to power the lamp 17 on each half cycle of the main 9 power alternating current cycle. The $-V_c$ line is coupled to the thyristor 501 cathode.

Figures 22, 23, 24, 25:
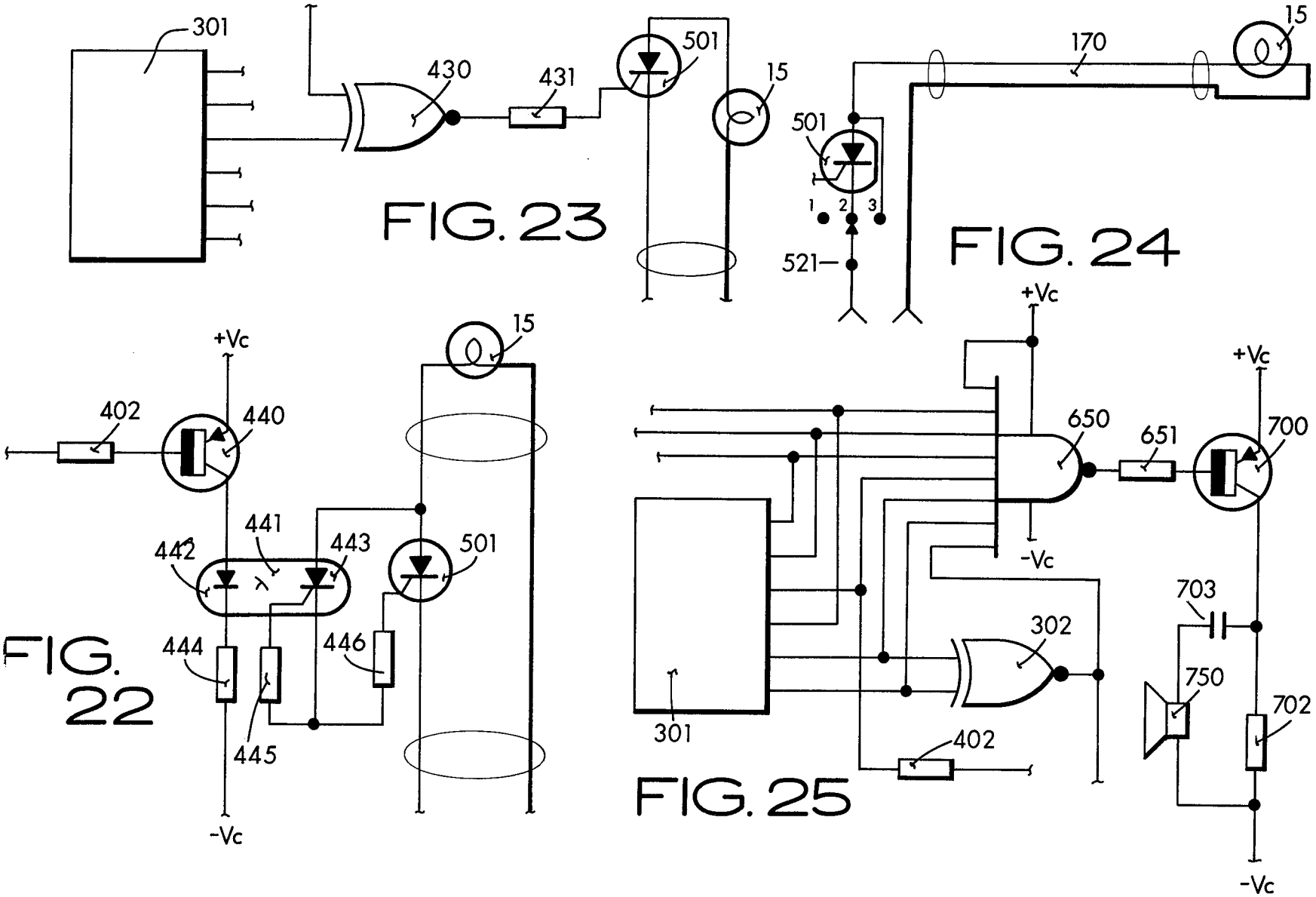
FIG. 22—Optical coupler isolation of the thyristor from the control signal circuits is taught.
FIG. 23—A logic gate, inverter, or buffer isolates the sequence generator from the effects of thyristor gate loading.
FIG. 24—A three-mode circuit configuration is explained.
FIG. 25—Audio click or pop signals are provided in a pseudorandom way by decoding various sequence generator outputs.

A transistor 440 driven optical coupler 441 is depicted in FIG. 22. The transistor drives a light emitting diode 442 or the like through ballast resistor 444. The resulting light flux fires light activated silicon controlled rectifier (LASCR) 443 which serves to pass power through gate resistor 446 to thyristor 501 when the thyristor 501 anode is positive. The LASCR sensitivity is fixed by LASCR gate swamping resistor 445.

A logic gate 430 or the like is shown as a buffer between the generator 301 output and the thyristor gate 501 in FIG. 23. Resistor 431 limits thyristor gate drive from the logic gate output.

A control switch 521 is shown in FIG. 24 which serves to selectively disable the flicker light controller. Position 1 is OFF; position 2 is NORMAL FLICKER MODE; position 3 bypasses the thyristor 501 and applies full, steady power to the lamp load.

The circuitry depicted in FIG. 25 serves to produce random "popping and crackling" sounds reminiscent of a burning material, for example a fireplace log. The audio signal is generated by the multiple NAND gate 650 connected to a plurality of the shift register 301 output lines. What results is a condition where the NAND gate 650 output can go logic "0" only when all the connected shift register outputs are logic "1", a condition which is relatively random and infrequent. The resulting gate 650 LOW state couples to amplifier transistor 700 through resistor 651. The result is the transistor saturates, pulling the collector to $+V_c$ thereby coupling the transistion as a pulse through capacitor 703 to a transducer 750, such as a radio loudspeaker or the like. The resulting "plop" is tailored through selection of capacitor 703 and resistor 702 values as well as transducer 750 construction to give a realistic popping sound.

Figures 26, 27, 28, 29, 30, 31:
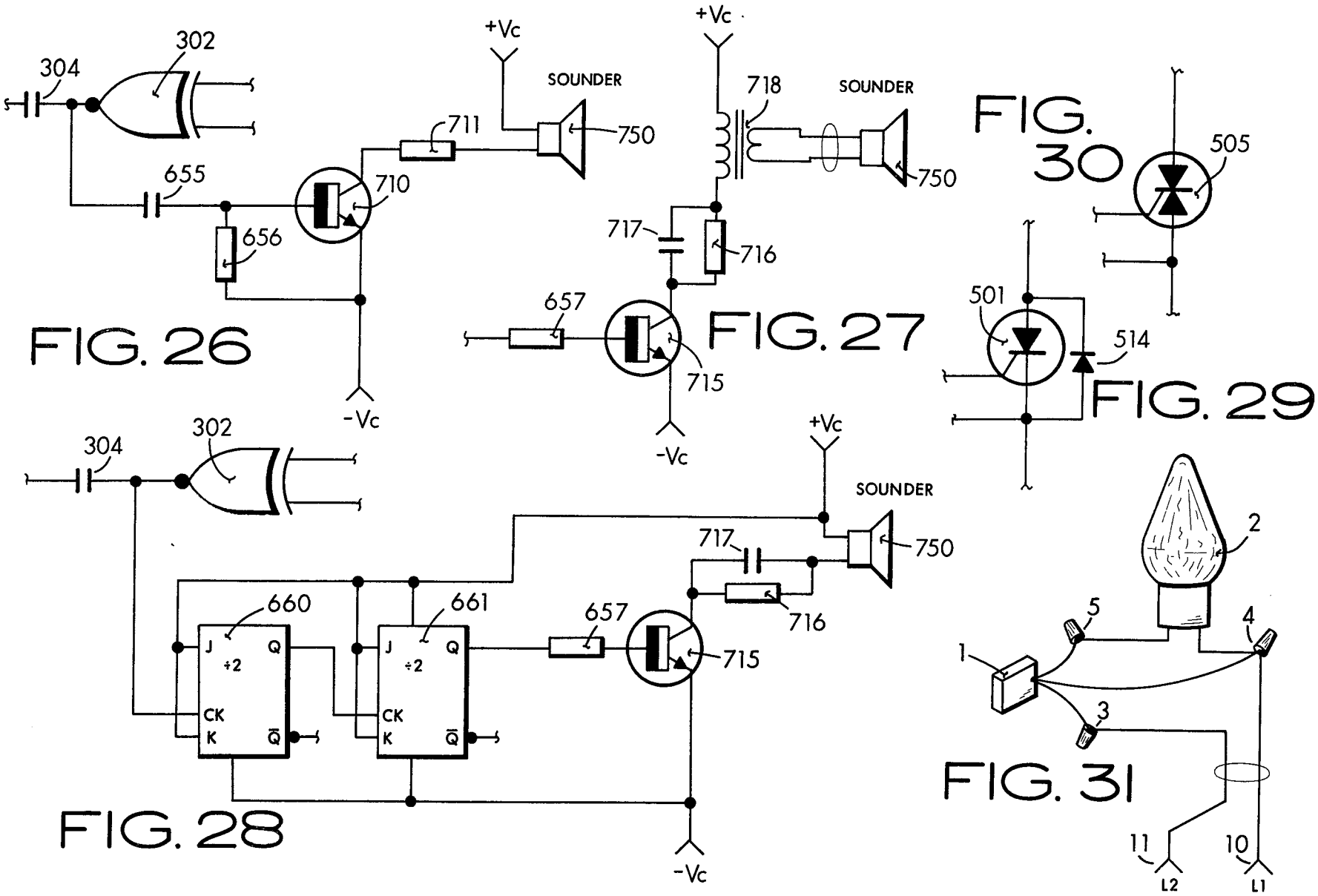
FIG. 26—Audio crackling signals are derived directly from pseudorandom signal path.
FIG. 27—Capacitor discharge driving of audio transducer is shown which achieves improved volume effect with reduced current drain.
FIG. 28—Divider means shown for reducing periodicity of the audio popping signal rate.
FIG. 29—Parallel inverse connected diode across the thyristor provides steady current flow in one direction and controlled current flow in the other direction.
FIG. 30—High gate sensitivity Triac type bilateral thyristor is shown as usable with drive means taught in FIGS. 3 and 19.
FIG. 31—Physical relationship of a typical controlled lamp and the modularized controller is shown.

A much faster rate popping sound is produced by the circuit in FIG. 26, as that from a blazing flame. The output of said gate 302 (or else any one of the shift register 301 outputs) acts as an audio signal which couples by capacitor 655 and resistor 656 to amplifier transistor 710 which serves to directly drive the sounder 750 through volume limiting resistor 711. The result is a popping sound with several random spaced "pops" every few seconds, whereas the hookup shown for FIG. 25 produces only a few such "pops" every ten of fifteen seconds.

In FIG. 27 the popping signal is produced by coupling the base of transistor 715 through resistor 657 to said gate 650 (see FIG. 25 audio signal) output or like source. The said transistor 715 collector couples to a transformer 718 through resistor 716 and capacitor 717. The sounder 750 connects to the transformer 718 secondary, with the transformer providing a degree of electrical isolation between the audio transducer 750 and the $+V_c$ line which is oftimes at line voltage level above ground. Said another way, the transformer permits magnetic coupling between the said primary and secondary, but blocks any direct electrical coupling therebetween so as to enhance the safety of the apparatus.

A divide by four counter function is shown in FIG. 28 as provided by flipflops 660, 661 for the purpose of reducing the periodicity of the audio popping sounds produced by the sounder 750. The counter input CLOCK connection, while shown derived from earlier said gate 302, might just as well be from earlier said gate 650 output or any shift register 301 output.

FIG. 29 shows the connection of a diode 514 in parallel with thyristor 501, the purpose for which is to provide 50% power to the lamp whilst the controlled thyristor provides a fluctuant 50% to 100% power.

FIG. 30 shows the use of a Triac class bilateral thyristor 505. The gate of the usual Triac requires more current than an equivalent power level silicon controlled rectifier and therefore is best used with the drive circuit of FIG. 3, rather than attempting direct drive from the shift register, or other, outputs.

The physical interconnection of a typical flicker light controller, built as a module 1, appears in FIG. 31. The controller is built on a printed circuit board or the like, encapsulated in plastic, and shows three lead connections 3, 4, 5 which connect to the mains power 10, 11 lines L1, L2 and to the lamp 2 controlled load. The installation as shown is what might be typical for the usual outdoor decorative electric lantern, viz pole lamp.

The invention is described using two or more separate integrated circuit elements; however the prudent artist will recognize this to be merely an expedient and therefore might elect to produce a single integrated circuit device encompassing all of the described circuit functions. This methodology, being well within the capability of known integrated circuit art form, is to be considered within the scope of my instant teachings.

While shown to use particular integrated circuits and other components, my teachings shall serve merely to instruct the artisan as to the essence of my invention, that being to produce a flicker light controller which controls integral power half cycles so as to produce a decorative controller having enhanced pseudorandom sequentiality, versatile application, and low cost.

The practitioner shall also understand that while means for providing both flickering light and popping sound effects are described, either effect may be used alone as well as in conjunction with one another and be within the scope of the teachings. Merely deleting one effect shall not serve to circumvent the essence of my invention.

While the flickering light effect is particularly described in conjunction with incandescent lamp elements, the term lamp elements shall be understood to include any source of light capable of electrical modulation, as for example fluorescent, mercury vapor, sodium vapor, neon discharge, or the like.

While this invention serves to particularly relate to that class of decorative lighting apparatus such as electric lanterns, holiday lights, and simulated fire devices, no restriction is implied to that class alone. Said another way, any conceivable device employing light which may benefit from pseudorandom modulation of the light intensity is subject to the claimed improvements provided by this invention. In particular, non-decorative devices such as electrical advertising displays, bug light devices, and the like are anticipated to benefit from these teachings.

What I claim is:

1. Light controller means operative to produce an irregular pattern of substantially binary power pulses for the purpose of at least producing a variegated flickering light effect from an electric lamp element wherein such flickering effect serves to simulate the flutter of a flame produced light, said controller principally including:

a. an input means to said controller coupled to a source of alternating current electric power;

b. at least one output means from said controller effectively coupled to a controlled electric lamp element load means;

c. switch means coupled between said input means and said output means, said switch means being alternatively effective to substantially connect and disconnect at least integral half a.c. power cycle current flow in at least one direction between said input means and said output means; and, d. a source of irregular pattern binary signal means operative to produce at least one sequential pattern of irregularly spaced first control pulses, said first control pulses being coupled to said switch means so as to serve to effectively provide at least integral half cycle control thereof.

2. Light controller means as in claim 1 wherein said switch means includes a thyristor class semiconductor device including at least a first main terminal means connected to the said input means, and a second main terminal means connected to said output means, further including gate terminal means operative therewith so as to initiate at least integral half cycle current flow between said main terminal means in response to the thereto coupled said first control pulses.

3. Light controller means as in claim 1 wherein said switch means includes a first unidirectional thyristor semiconductor device coupled between said input means and said output means so as to control integral half cycle current flow in a first direction therebetween.

4. Light controller means as in claim 1 wherein said switch means includes a first unidirectional thyristor semiconductor device coupled between said input means and said output means so as to control integral half-cycle current flow in a first direction therebetween and additionally includes a second unidirectional thyristor semiconductor device coupled effectively in parallel with, but with reversed polarity sense to said first unidirectional thyristor semiconductor device, and cooperative therewith so as to control integral half cycle current flow in a second direction between the said input means and said output means.

5. Light controller means as in claim 1 wherein said output means as coupled to said controlled load means includes a diode means effective as an unidirectional current flow means connected substantially in series circuit arrangement with the current flow through at least one unidirectional thyristor semiconductor device, operative so as to enable integral half cycle current flow to the said controlled load means in but one direction, say first direction or else second direction.

6. Light controller means as in claim 1 wherein said switch means includes:

a. a unidirectional thyristor semiconductor device coupled between said input means and said output means, operative conjunctively with said source of irregular pattern signal means so as to produce a controlled pattern of integral half cycle current flow pulses in a first direction between said input means and said output means; and, b. a diode means effective as a unidirectional current flow means coupled between said input means and said output means so as to provide substantially continuous integral half cycle pulses in a second direction therebetween.

7. Light controller means as in claim 1 wherein said switch means is essentially comprised of a unidirectional thyristor semiconductor device connected cooperatively with a bridge arrangement of unidirectional current flow control elements thereby being operative to effectively control integral half cycle current flow pulses in both a first direction and a second direction between the said input means and the said output means in accord with the sequential pattern of irregularly spaced first control pulses produced by the said source of irregular pattern binary signal means.

8. Light controller means of claim 1 wherein further is included:

a. mechanical switch means effective for providing control of at least one of several possible current flow combinations between the said controller means and at least one said controlled load means;

b. at least one diode means effective as an unidirectional current flow means coupled in combination with said mechanical switch means so as to effectively enable current flow to the said controlled load means in but one direction; and, c. means for selectively altering the combination of the said diode means relative to the said controlled load means current flow paths by way of the said mechanical switch means so as to serve to alter the lighting effect produced by the said controlled load means.

9. Light controller means as in claim 1 wherein said source of irregular pattern signal is provided by a source of at least pseudorandom noise signal.

10. Light controller means as in claim 1 wherein said source of irregular pattern signal includes at least a binary shift register circuit configuration, coupled in the manner of a pseudorandom binary sequence generator.

11. Light controller means as in claim 1 wherein said source of irregular pattern signal in part includes:

a. binary sequential switching circuit operative as a shift register means including at least one data signal input and at least one actuating clock signal input thereto, and a plurality of outputs therefrom wherein further at least one output therefrom is inverted relative to any other outputs;

b. binary switching network means including a plurality of inputs thereto effectively coupled to said shift register outputs, wherein said network effectively satisfies the logic function "EXCLUSIVE-OR", or else "EXCLUSIVE-NOR", providing an output therefrom which serves to be effectively coupled to said shift register means input; and, c. source of actuating clock signals coupled to said shift register said clock signal input and effective therewith so as to sequentially step said shift register means said plurality of outputs through a substantial number of pseudorandom binary state combinations.

12. Light controller means as in claim 1 wherein said source of irregular pattern signal includes a clock signal for the operation thereof, wherein further said source of mains power is an alternating current signal, with said clock signal being accordingly derived from said mains power said alternating current signal.

13. Light controller means as in claim 1 wherein said source of irregular pattern signal means serves to effect a plurality of instantaneously various value irregularly spaced first control pulse output signals each of which serves to control a separate switch means.

14. Light controller means as in claim 1 wherein said source of irregular pattern signal means includes at least a memory storage means which is purposefully programmed with an irregular sequence of signal values so as to effectively serve as a source of irregularly spaced first control pulses.

15. Light controller means as in claim 1 wherein said controlled load means is electric light bulb.

16. Light controller means as in claim 1 wherein said controlled load means is a decorative electric lighting device.

17. Light controller means as in claim 1 wherein said controlled load means is an electrical lighting chandelier means including a plurality of electric lamp elements, wherein further at least two of the said electric lamp elements are operated from the said controller in an effectively separate current flow path so as to produce lighting effects therefrom of instantaneously differing value.

18. Light controller means as in claim 1 wherein said controlled load means is a holiday type electrical lighting device, wherein at least a first current flow circuit and a second current flow circuit is included as a part thereof, wherein the said lighting device further comprises at least a first combination of electric lighting element means coupled to operate with said first current flow circuit, and further includes at least a second combination of electric lighting element means coupled to operate with said second current flow circuit.

19. Light controller means as in claim 1 wherein:

a. said source of irregular pattern signal means is operative to produce a sequential pattern of irregularly spaced second control pulses; and further including:

b. audible signal generator means having an input thereto coupled to said irregularly spaced second control pulse signal, providing an output therefrom of second control pulse signals; and, c. acoustical translator means coupled to said audible signal generator means, operative to receive second control pulse signals therefrom and resultingly produce an audible sensory signal.

20. Light controller means as in claim 1 wherein further is included:

a. a source means for a sequential pattern of irregularly spaced second control pulses;

b. audible signal generator means coupled to said sequential pattern of irregularly spaced second control pulse source means; and, c. acoustical translator means coupled to said audible signal generator means.

21. Light controller means as in claim 1 wherein:

a. said source of irregular pattern signal means is operative to produce a sequential pattern of irregularly spaced second control pulses; and further including:

b. audible signal generator means having an input thereto coupled to said irregularly spaced second control pulse signal, providing an output therefrom of second control pulse signals;

c. acoustical translator means coupled to said audible signal generator means, operative to receive second control pulse signals therefrom and resultingly produce an audible sensory signal;

which is in further combination with:

d. an artistic arrangement means of firewood or the like purposefully serving to suggest the combination of such means as usually used in a fireplace, stove, campfire, or the like;

e. at least one electric lamp element artistically arranged in combination with said artistic arrangement means so as to produce a glowing effect which serves to provide the specious effect of fire and burning embers;

f. cooperation between the said light controller means and the said artistic arrangement means including the said electric lamp element so as to produce the illusory effect of flame burst and ember glow variations to be emanative from the said artistic arrangement means.

22. Light controller means as in claim 1 wherein:

a. said source of irregular pattern signal means is operative to produce a sequential pattern of irregularly spaced second control pulses; and further including:

b. audible signal generator means having an input thereto coupled to said irregularly spaced second control pulse signal, providing an output therefrom of second control pulse signals;

c. acoustical translator means coupled to said audible signal generator means, operative to receive second control pulse signals therefrom and resultingly produce an audible sensory signal;

which is in further combination with:

d. an artistic arrangement means of firewood or the like purposefully serving to suggest the combination of such means as usually used in a fireplace, stove, campfire, or the like;

e. at least one electric lamp element artistically arranged in combination with said artistic arrangement means so as to produce a glowing effect which serves to provide the specious effect of fire and burning embers;

f. cooperation between the said light controller means and the said artistic arrangement means including the said electric lamp element so as to produce the illusory effect of flame burst and ember glow variations to be emanative from the said artistic arrangement means;

wherein still further is included:

g. acoustical translator means arranged in proximateness to said artistic arrangement means so as to give the illusion of sound emission directly from the said artistic arrangement means; and, h. audible signal generator means as coupled to said second control pulses and said acoustical translator, the combination thereof serving to produce from the acoustical translator a succession of audible emanations which serve to effect the specious illusion of the popping and crackling of a burning material.

23. Light controller as in claim 1 wherein further is included:

a. adjustable control means operative to effect a change in the average power coupled to the said controlled load means by the said switch means.

24. Light controller as in claim 1 wherein further is included:

a. adjustable control means effective to cause said first control pulses, as coupled to said switch means, to be varied in waveform efficacy so as to produce an average change in the power applied to the said controlled load, as compared to the instantaneous change in power produced by the irregular spacing of the said first control pulses.

25. Light controller as in claim 1 wherein further is included:

a. said irregularly spaced first control pulses produced to be at least generally various in time spacing from at least one edge of any one pulse to the corresponding edge of any other pulse in a sequence of pulses as controlled by said source of irregular pattern signal means.

26. Light controller means as in claim 1 wherein said controller apparatus is contained within an electric lighting element adapter, viz the said apparatus is contained within an enclosure means which on the first end thereof provides a female receptacle connected to said switch means said output means and is effective to receive the connective means for an electric lighting element, whilst on the second end thereof a male connective plug, connected to the said switch means said input means, is included which is accepted by the female electric lighting device receptacle or socket usually included as a part of a typical electrical lighting fixture, said adapter being operative therewith to provide effectual control of the current flow between the said first end said female receptacle and the said second end said male connective plug.

* * * * *